United States Patent [19]

Tzeng

[11] Patent Number: 4,512,575

[45] Date of Patent: Apr. 23, 1985

[54] RACQUET HAVING STRINGS OF EQUAL LENGTH

[76] Inventor: Kuo-Nan Tzeng, No. 35-4, Sec. 3, Chinan Rd., Taipei, Taiwan

[21] Appl. No.: 445,737

[22] Filed: Nov. 30, 1982

[51] Int. Cl.[3] ..... A63B 49/02

[52] U.S. Cl. ..... 273/73 D; 273/73 C

[58] Field of Search ..... 273/73 C, 73 D, 73 R, 273/29 A, 29 B, 73 G, 73 E; D21/210–212

[56] References Cited

U.S. PATENT DOCUMENTS

| | | | |
|---|---|---|---|
| 2,165,701 | 7/1939 | Goerke | 273/73 E |
| 3,834,699 | 9/1974 | Pass | 273/73 C X |
| 3,999,756 | 12/1976 | Head | 273/73 D X |
| 4,013,289 | 3/1977 | Kaminstein | 273/73 D |

FOREIGN PATENT DOCUMENTS

| | | | |
|---|---|---|---|
| 2455906 | 1/1981 | France | 273/73 D |

*Primary Examiner*—Richard C. Pinkham
*Assistant Examiner*—Matthew L. Schneider

[57] ABSTRACT

A racquet for use in playing tennis and other ball and racquet games has a stringing pattern which comprises a pair of longitudinal central strings (5′) located symmetrically one on each side of the central longitudinal axis of the racquet frame, and four additional strings disposed outwardly of each of the central strings. The stringing pattern also comprises a pair of transverse strings (5″) located symmetrically one on each side of the central transverse axis at a distance of approximately 40% of the length (L) of the strung surface as measured from the inner edge of the racquet throat (3). Also, both in directions toward the tip of the racquet frame (6) and toward the throat (3) four additional strings are arranged. Additional longitudinal and transverse strings are provided that are arranged outwardly from the aforementioned strings. An effective strike area is constituted by the cross-linking of the ten longitudinal and ten transverse strings corresponding to the scope of that area, the inner edges of the frame tip (16) and of the throat (3) being parallel and of identical curvature and the inner edges of both sides of the frame being arranged at minimum curvature.

3 Claims, 1 Drawing Figure

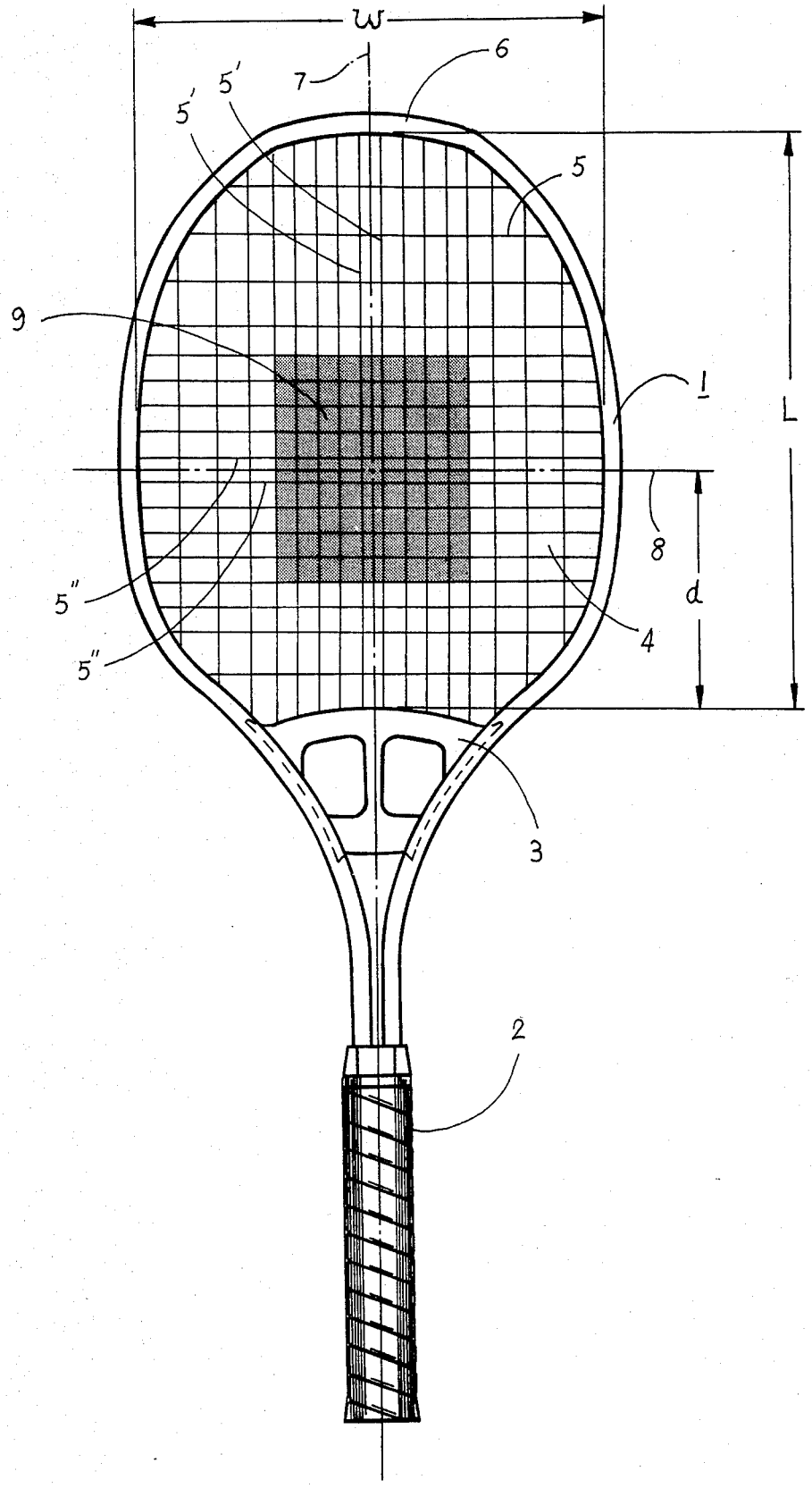
W
6
7
5'
5'
5
9
1
L
8
d
5"
5"
4
3
2

RACQUET HAVING STRINGS OF EQUAL LENGTH

This invention relates to a racquet for use in tennis and other ball and racquet games.

Conventionally, the strung surface defined by a racquet frame and throat is substantially elliptical. Thereby, the lengths of those longitudinal strings which pass through the effective strike area are different from each other, and similarly the lengths of those transverse strings which pass through the effective strike area are also different to each other. It thus happens that the tension and thus the rebound action at each spot within the effective strike area are not uniform. This will adversely effect tennis-playing performance.

It is the main intention of the present invention to provide a tennis raquet having a uniform tension and rebound action in the effective strike area.

The characteristics of the invention should become more apparent from the following description with reference to the sole accompanying drawing which is a plan view of a preferred embodiment of a tennis racquet in accordance with the invention.

Referring now to the drawing, the tennis racquet mainly comprises a frame 1, a handle 2, and a throat 3. The throat 3 is secured within the frame to define a strung surface 4 therewith.

The strings 5 are threaded through the frame 1 and the throat 3 as usual over the entire area of the strung surface 4 to form a set of strings extending in a generally longitudinal direction and another set of strings extending in a generally transverse direction. The length L of the strung surface 4 is defined by the inner edges of the throat 3 and of the frame tip 6. The length W of the strung surface 4 is defined by the inner edges of both sides of the frame 1.

A pair of longitudinal centre strings 5' are arranged symmetrically one on each side of the central longitudinal axis 7 of the frame 1 and spaced from one another at a centre-to-centre distance of 1.0 to 1.2 cm. Disposed outwardly from the two centre strings 5' at both sides are four additional strings arranged at the same centre-to-centre distance as mentioned above, namely 1.0 to 1.2 cm. There is thus a total of ten longitudinal strings.

A pair of transverse centre strings 5'' are arranged symmetrically one on each side of the transverse axis 8 which is at a distance d of approximately 40% of the length L of the strung surface 4 as measured from the inner edge of the throat 3, and spaced from one another at a centre-to-centre distance of 1.2 to 1.4 cm. Then in both directions towards the frame tip 6 and towards the throat 3, four additional strings are arranged at the same centre-to-centre distance as mentioned above, namely 1.2 to 1.4 cm. There is thus also a total of ten transverse strings.

The area embraced by the aforementioned cross-linked ten longitudinal and ten transverse strings is referred to as the effective strike area 9. In order to make the length of these ten longitudinal strings substantially the same for ensuring uniform tension and rebound action, the inner edges of the frame tip 6 and of the throat 3 are parallel and of identical curvature such that a maximum deviation of ±0.25 cm in the length L is allowed. For a similar purpose to make the length W of these ten transverse strings substantially the same, the inner edges of both sides of the frame 1 are arranged at a minimum curvature such that a maximum deviation of ±0.65 cm in the length W is allowed. By this arrangement, the tension and rebound action in this effective strike area 9 are substantially uniform at any spot.

Further disposed longitudinally outwardly from the effective strike area 9 at both sides are three additional strings arranged so that their centre-to-centre distance progressively increases. Also transversely from the effective strike area 9 there are four additional strings in the direction toward the frame tip 6 and three additional strings in the direction toward the throat 3 such that their centre-to-centre distance also progressively increases. Thus a preferred stringing pattern comprised of 17 strings in a transverse direction and 16 strings in a longitudinal direction is constituted.

The aforementioned embodiment serves only for illustrative purposes and by no means restricts the scope of the present invention as defined in the appended claims.

I claim:

1. A tennis racquet comprising a frame, a handle and a throat, the throat being secured within the frame to define a strung surface therewith, said frame comprising a frame tip located opposite said throat, said frame tip and throat having inner edges defining the boundaries of said strung surface in a longitudinal direction, said frame further comprising two sides oppositely arranged, said two sides having inner edges defining the boundaries of said strung surface in a transverse direction, said strung surface having a stringing pattern comprising a pair of longitudinal central strings located symmetrically one on each side of a central longitudinal axis of the frame, four additional strings disposed outwardly of each of the central strings to make ten longitudinal strings and a plurality of strings disposed outwardly of said ten longitudinal strings; a pair of transverse central strings located symmetrically one on each side of an axis extending in the transverse direction of the frame, said last named axis being located at a distance approximately 40% of the length of said strung surface as measured from the inner edge of the throat to the tip of the frame, and both in directions toward the tip of the frame and toward the throat, four additional strings being arranged to make ten transverse strings, there being as well a plurality of strings on either side of said ten transverse strings, the total number of the last named plurality of strings on the frame tip side of the racquet being no more than the number of the last named plurality of strings on the throat side of the racquet, plus one; an effective strike area being constituted by the cross-linking of said ten longitudinal and ten transverse strings, and corresponding to the scope of said area the inner edges of the frame tip and of the throat being parallel and of an identical curvature, said curvature of said inner edge of the throat facing said area being of convex shape, and the inner edges of both sides of the frame being arranged at a minimum curvature.

2. A racquet as set forth in claim 1, wherein the centre-to-centre distance between any adjacent strings of the ten longitudinal strings is the same, and the centre-to-centre distance between any adjacent strings of the ten transverse strings is also the same.

3. A racquet as set forth in claim 1, wherein the lengths of the ten longitudinal strings are substantially the same with a maximum deviation of ±0.25 cm and the lengths of the ten transverse strings are also substantially the same with a maximum deviation of ±0.65 cm.

* * * * *